US005743391A

United States Patent [19]

Hsiao

[11] Patent Number: 5,743,391

[45] Date of Patent: Apr. 28, 1998

[54] WHEEL RETAINING DEVICE

[75] Inventor: Louis Hsiao, 765A Loma Verde Ave., Palo Alto, Calif. 94303

[73] Assignee: Louis Hsiao, Palo Alto, Calif.

[21] Appl. No.: 756,655

[22] Filed: Nov. 26, 1996

Related U.S. Application Data

[63] Continuation-in-part of Ser. No. 444,308, May 18, 1995, Pat. No. 5,586,649.

[51] Int. Cl.[6] ..... B65D 85/02

[52] U.S. Cl. ..... 206/303; 211/23; 220/475

[58] Field of Search ..... 206/303, 304, 206/304.1, 304.2; 211/19, 20, 23, 24, 49.1; 220/475

[56] References Cited

U.S. PATENT DOCUMENTS

| | | | |
|---|---|---|---|
| 444,328 | 1/1891 | Boss . | |
| 536,445 | 3/1895 | Rockwell . | |
| 1,190,152 | 7/1916 | Gross . | |
| 1,225,952 | 5/1917 | Hamilton . | |
| 1,277,211 | 8/1918 | Graham . | |
| 1,419,871 | 6/1922 | McDonald . | |
| 1,476,319 | 12/1923 | Angier | 206/304 |
| 1,486,983 | 3/1924 | McDonald . | |
| 1,508,239 | 9/1924 | O'Brien . | |
| 1,527,386 | 2/1925 | Barnard | 206/303 |
| 1,561,201 | 11/1925 | Wocel . | |
| 1,620,148 | 3/1927 | Williams . | |
| 1,909,429 | 5/1933 | Sherman . | |
| 2,001,475 | 5/1935 | Vogt . | |
| 2,103,684 | 12/1937 | Long | 220/475 |
| 2,626,062 | 1/1953 | Manzella . | |
| 2,670,085 | 2/1954 | Sorrento | 211/59 |
| 2,882,170 | 4/1959 | Stewart | 206/303 |
| 2,928,540 | 3/1960 | Cunningham . | |
| 3,093,149 | 6/1963 | Jaffee . | |
| 3,127,018 | 3/1964 | McMasters . | |
| 3,139,986 | 7/1964 | Strock . | |
| 3,265,224 | 8/1966 | Skubic . | |
| 3,280,987 | 10/1966 | Steinbock | 206/303 |
| 3,378,183 | 4/1968 | Ferrer | 211/49.1 |
| 3,472,466 | 10/1969 | Rutschi . | |
| 3,547,258 | 12/1970 | Black | 211/23 |
| 3,759,394 | 9/1973 | Hottle | 211/23 |
| 4,573,587 | 3/1986 | Matthews, Jr. | 211/23 |
| 5,503,277 | 4/1996 | O'Brien . | |

*Primary Examiner*—Jimmy G. Foster
*Attorney, Agent, or Firm*—Janet E. Muller; Flehr Hohbach Test Albritton & Herbert

[57] ABSTRACT

A wheel retaining device for retaining a plurality of replacement wheels. The wheel retaining device includes an elongate body dimensioned for insertion through apertures formed in the wheels and retainers positioned proximate opposite ends of the elongate body for retaining the wheels on the elongate body. The wheel retaining device includes a locking mechanism for securing the wheels on the elongate body.

11 Claims, 9 Drawing Sheets

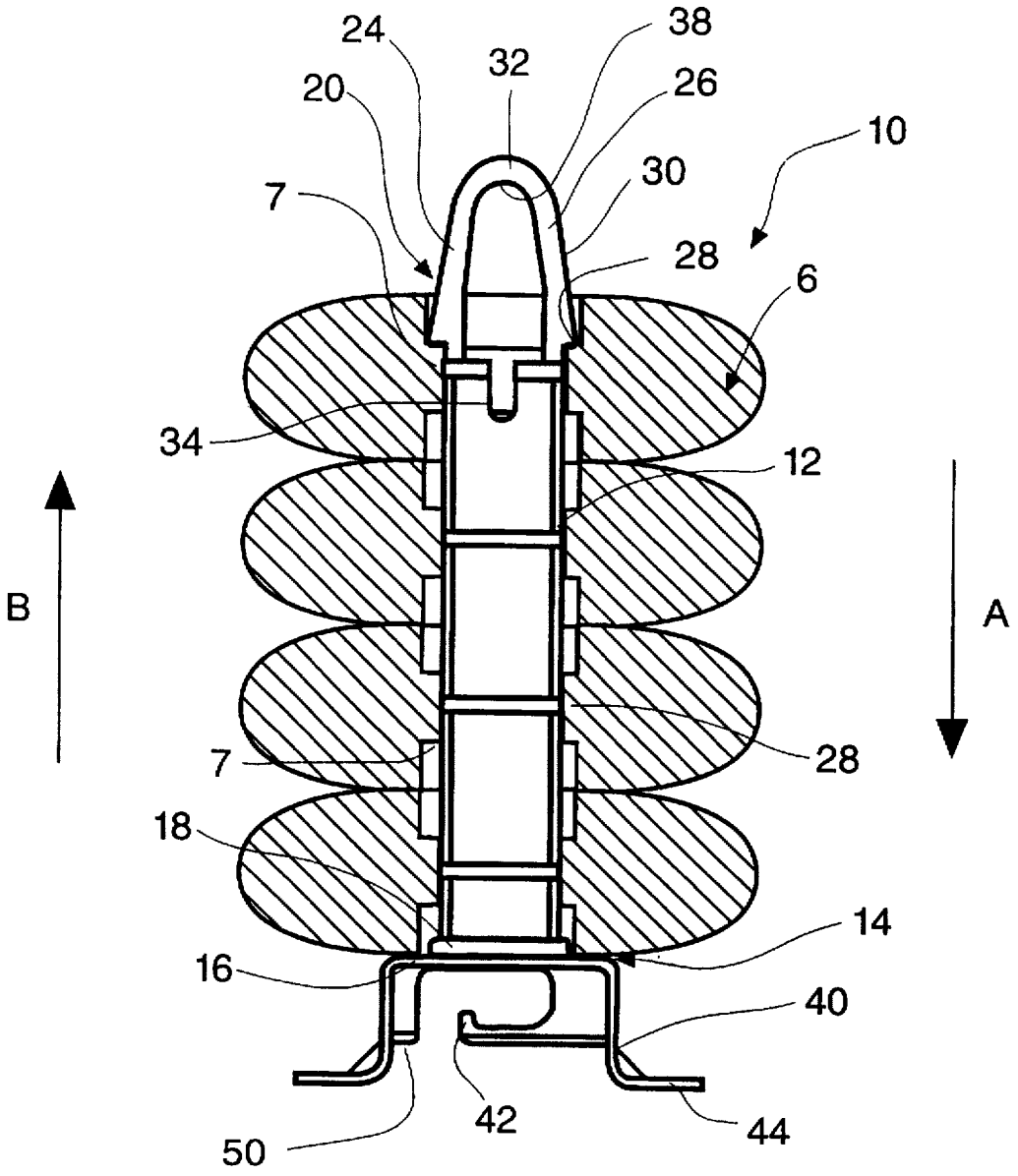
FIG.__ 1

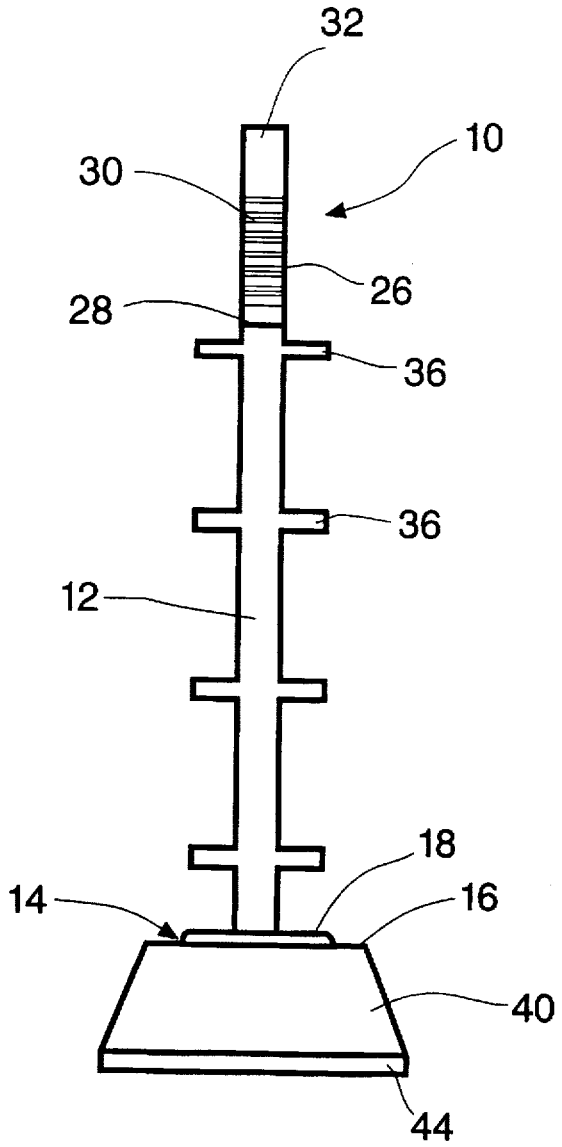
FIG.__ 2

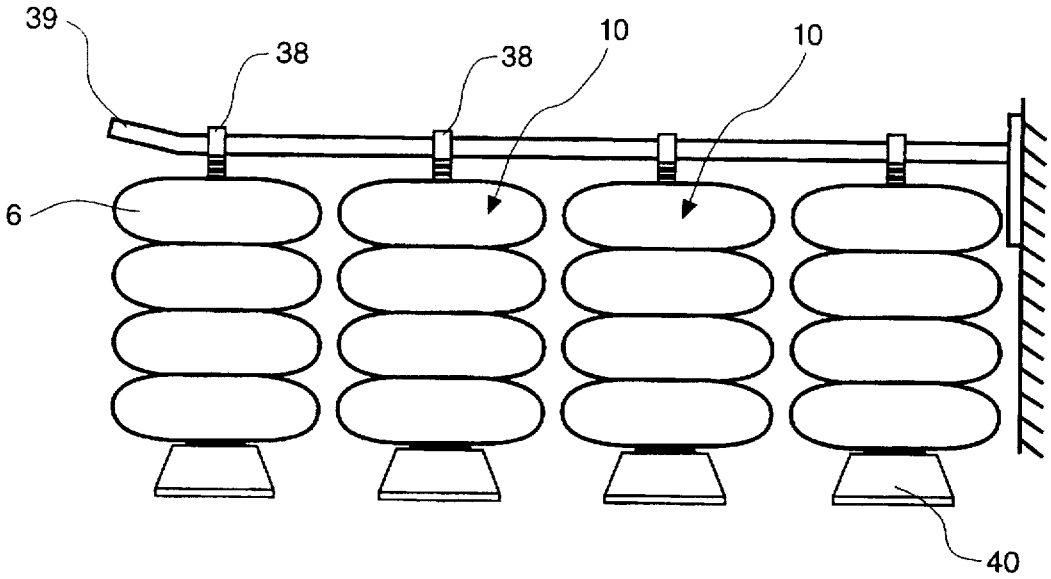
FIG.__ 3
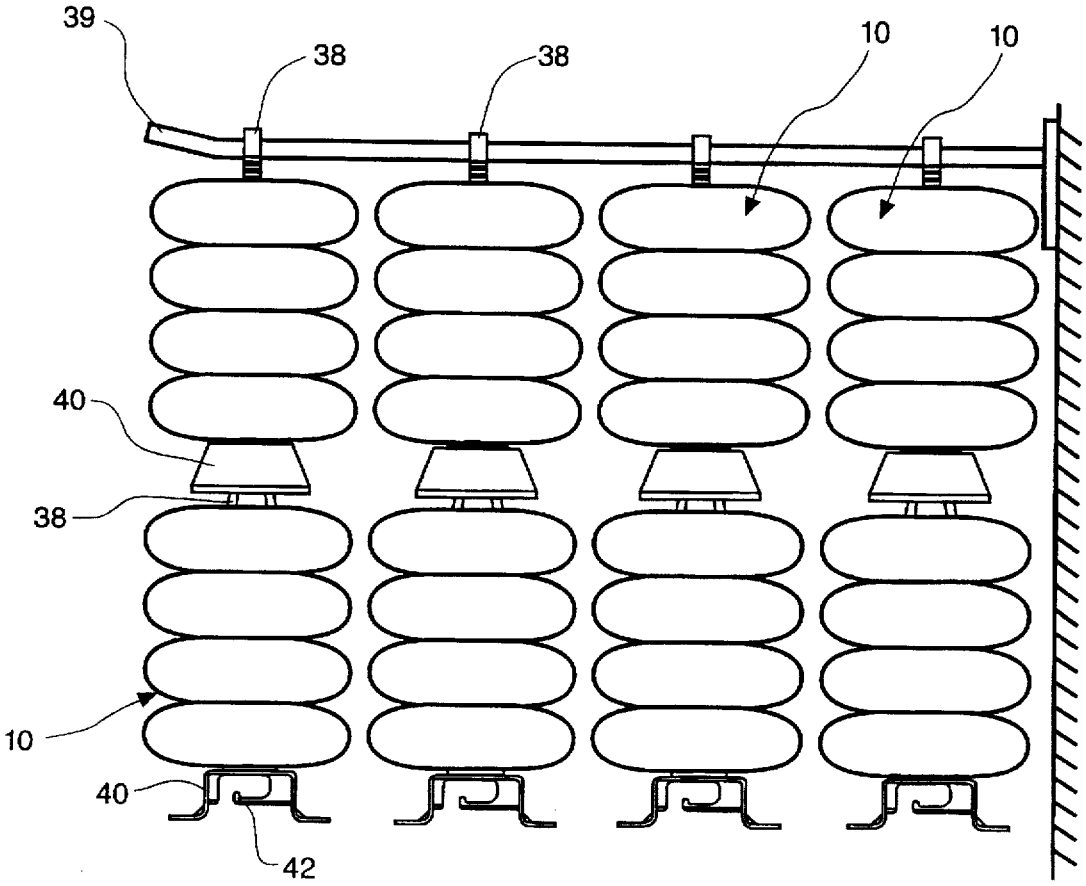
FIG.__ 4

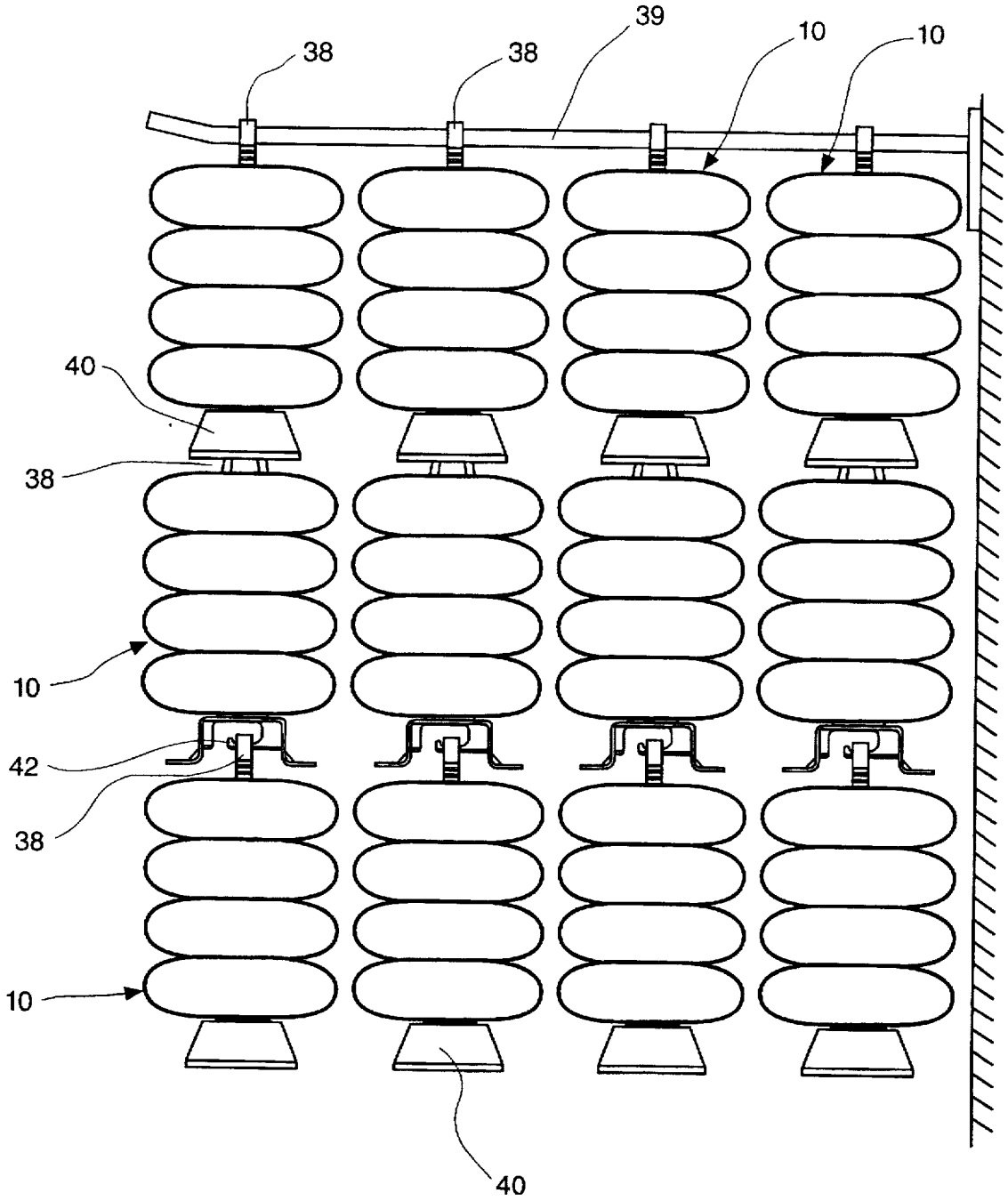
FIG.__ 5

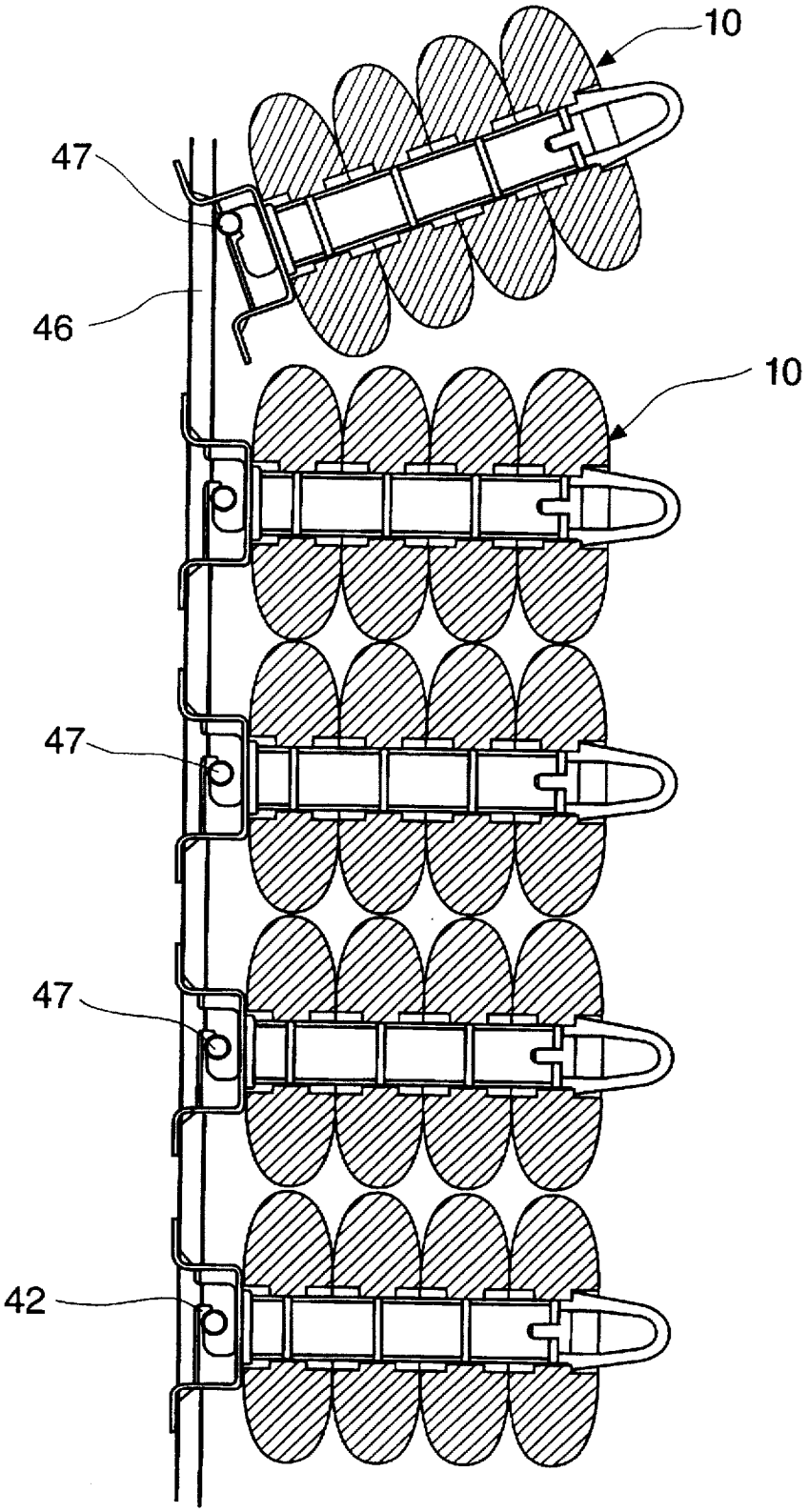
FIG.__ 6

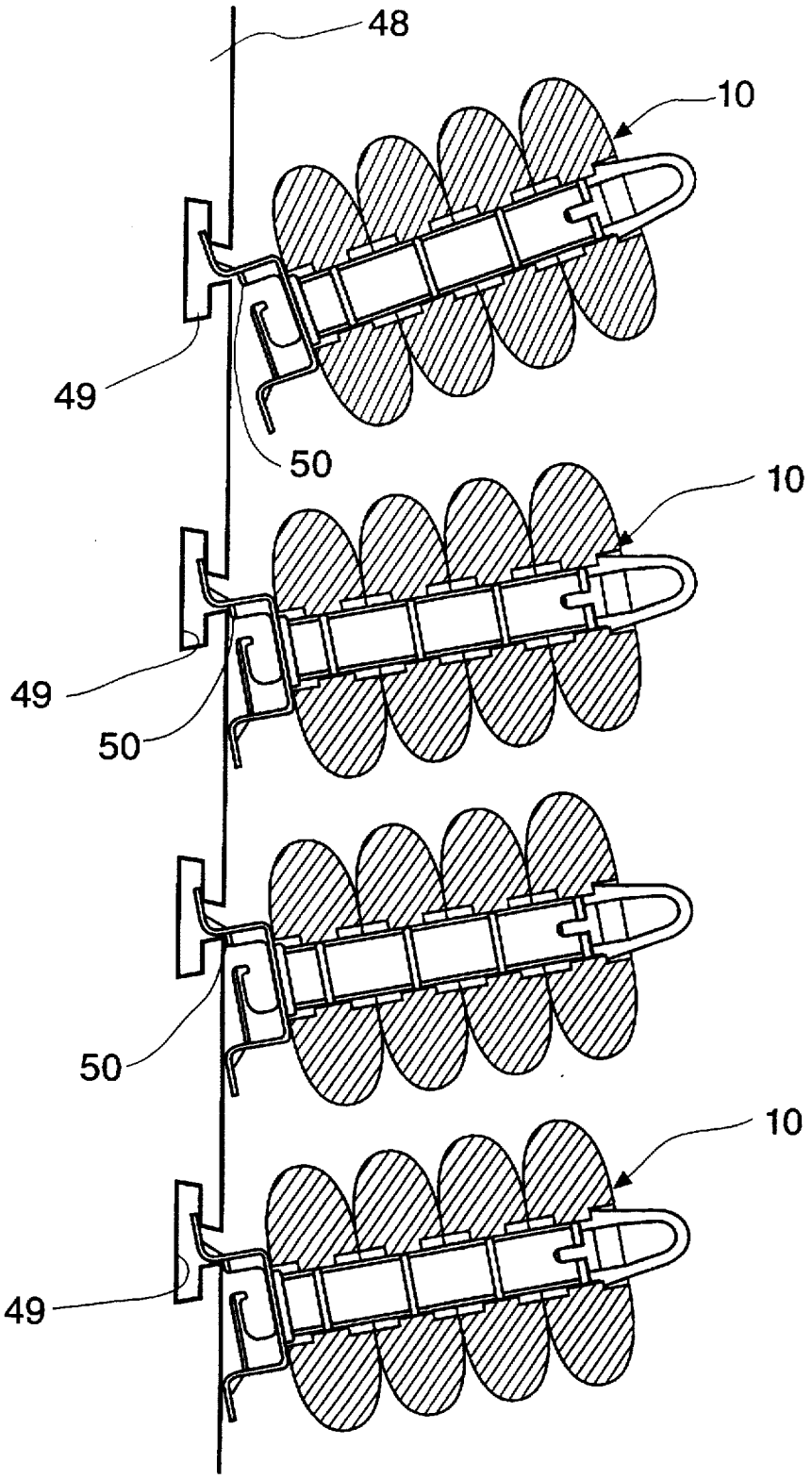
FIG.__ 7

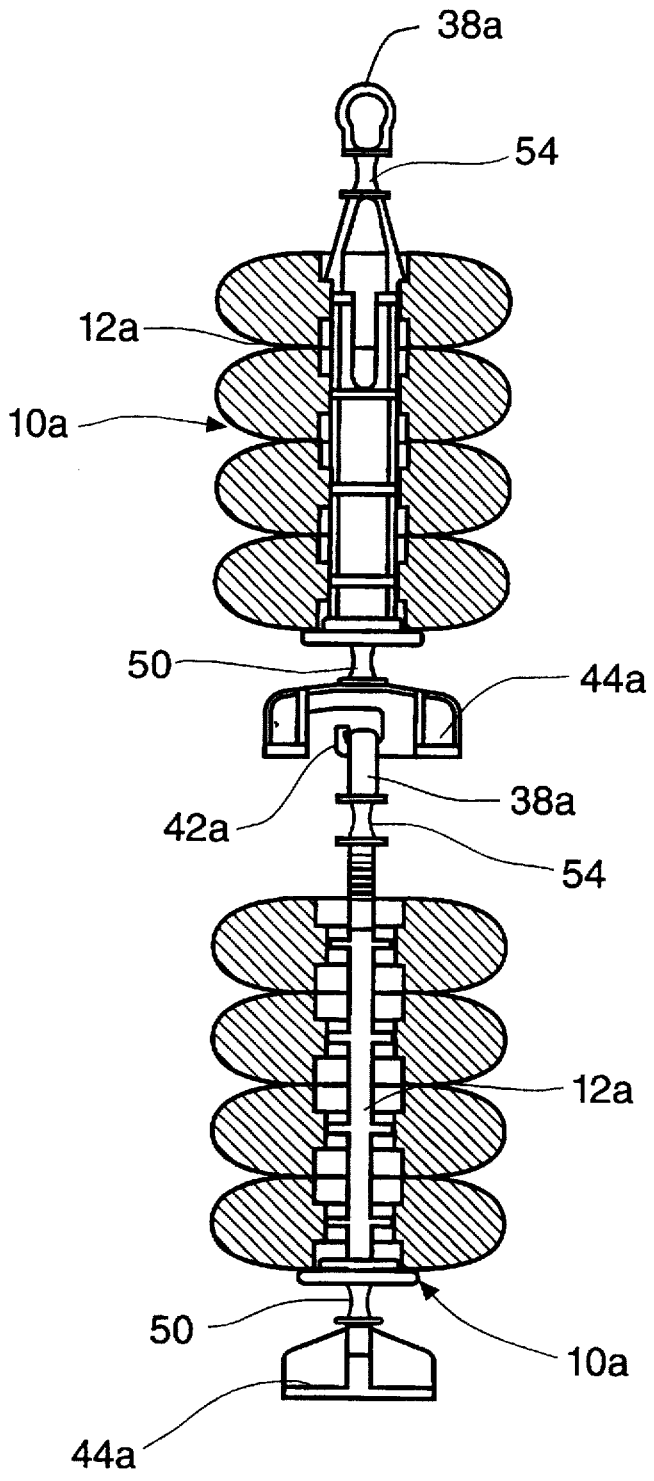
FIG.__ 8

WHEEL RETAINING DEVICE

CROSS REFERENCE TO RELATED APPLICATIONS

This application is a continuation-in-part of U.S. patent Ser. No. 08/444,308 filed May 18, 1995, U.S. Pat. No. 5,586,649, the disclosure of which is incorporated herein by reference.

BACKGROUND OF THE INVENTION

1. Field of the Invention

This invention relates to a new and improved device for retaining wheels. More particularly, the present invention relates to a wheel retaining system for efficiently packaging a set of wheels.

2. Prior Art

A user may wish to replace the wheels of his in-line skates, roller skates, skateboard and the like for numerous reasons including for example replacing worn wheels, upgrading to a higher quality wheel or selecting a wheel which is more suited for a particular activity. Replacement wheels are often supplied to the merchant in bulk form, with the merchant displaying a large quantity of wheels in an open container from which the consumer may retrieve the desired number of replacement wheels. Supplying the wheels in bulk requires minimal packaging efforts on the part of the wheel manufacturer. However, displaying loose wheels in an aesthetically appealing and ordered manner may be inconvenient and difficult for the merchant. Similarly, the consumer may find selecting and individually purchasing several wheels inconvenient and time consuming. Moreover, a consumer may unfairly assume that the bulk wheels are of a lesser quality than those sold in packages.

Replacement wheels are available in sets packaged in plastic clamshell-type packages. The clamshell packages, which typically hold a set of four wheels, are easier to display and market than the loose wheels. However, the packaging increases the cost of the wheels and disposing of the excess materials employed in the clamshell packages raises environmental issues.

This invention provides a new and improved system for packaging replacement wheels. The retaining device securely holds a plurality of wheels. The replacement wheels may be easily positioned on the retaining device and securely retained in place until they are removed by pulling the wheels from the device. The wheel retaining device is configured for conveniently displaying the retaining device.

SUMMARY OF THE INVENTION

The wheel retaining device of the present invention is particularly suitable for packaging a set of replacement wheels for in-line skates, roller skates, skate boards and the like. The wheel retaining device includes an elongate body which has spaced first and second ends and is dimensioned for insertion through the holes formed in the wheels. Retainers positioned proximate the ends of the elongate body holds the wheels on the elongate body.

In one modification of the invention, at least one of the retainers is resiliently deformable so that the wheels may be moved past the retainer and onto or off of the elongate body. The retaining device includes a locking mechanism which, when engaged, prevents the deformation of the retainer to securely hold the wheels on the elongate body.

In another modification of the invention, the elongate body is formed of a plurality of links and the retainers have a size greater than the opening formed in the wheels.

BRIEF DESCRIPTION OF THE DRAWINGS

The accompanying drawings, which are incorporated in and form a part of this specification, illustrate embodiments of the invention and, together with the description, serve to explain the principles of the invention:

FIG. 1 is a side view of a wheel retaining device in accordance with the invention, shown holding a plurality of wheels.

FIG. 2 is a side view of the wheel retaining device of FIG. 1 rotated 90°.

FIGS. 3–5 are side views showing several wheel retaining devices as displayed using display rods.

FIG. 6 is a side view showing several retaining devices as displayed on a grid wall display.

FIG. 7 is a side view showing several retaining devices as displayed on a slat wall display.

FIG. 8 is a side view of another embodiment of a wheel retaining device.

DETAILED DESCRIPTION OF THE PREFERRED EMBODIMENTS

Figure 9:
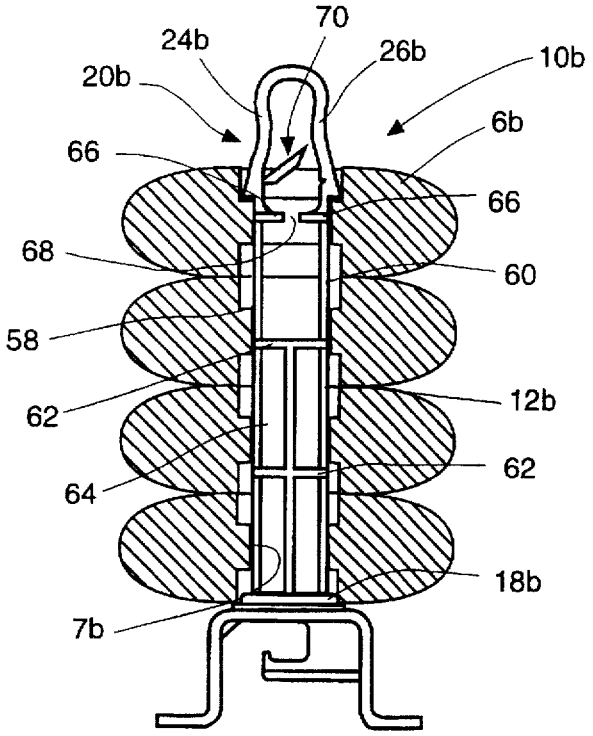
FIG. 9 is a side view of another embodiment of a wheel retaining device.
Figure 10:
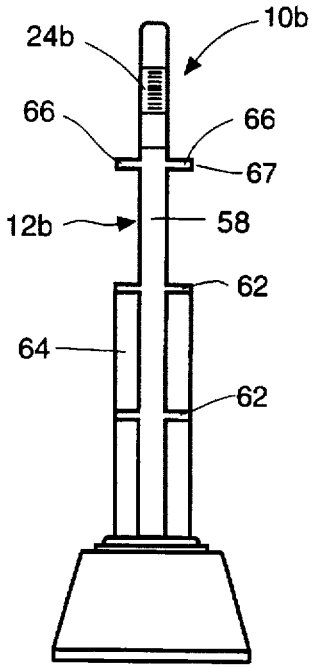
FIG. 10 is a side view of the wheel retaining device of FIG. 9.
Figure 11:
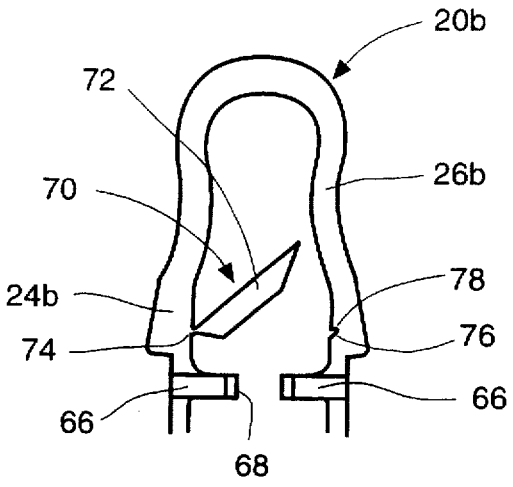
FIGS. 11 and 12 are enlarged views of the retainer of the wheel retaining device of FIG. 9, shown with the locking mechanism in the disengaged and engaged positions, respectively.

Reference is now made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

A wheel retaining device 10 retaining a plurality of replacement wheels 6 is shown particularly in FIGS. 1 and 2. The wheel retaining device of the invention may be used to hold a variety of wheels including wheels for in-line skates, roller skates, skate boards and the like. In the specification and claims, the term "wheels" is used to refer to the entire wheel assembly as well as the individual components of a wheel assembly such as the hub, tire, etc. By way of example, retaining device 10 is shown retaining elliptical-shaped rollers of the type used in in-line skates. The wheels 6 are formed with an aperture 7 extending through the body of the wheel and an interior hub 8 shaped to receive the skate axle. In the illustrated embodiment, the wheel retaining device holds four such wheels, the number of replacement wheels typically required for one skate. However, wheel retaining device 10 may be adapted to retain any number of wheels as desired.

Wheel retaining device 10 has an elongate body portion 12 shaped to hold a plurality of wheels 6 with the elongate body portion extending through the apertures 7 in the wheels and a first retainer 14 positioned proximate the lower end of the elongate body portion for supporting wheels 6 on the body portion 12. In the illustrated embodiment, the first retainer 14 comprises a support flange 16 extending outwardly from the elongate body portion 12 to engage a portion of the lowermost wheel 6 surrounding the aperture 7. Preferably, the flange 16 extends around the entire circumference of the elongate body portion 12. However, it is to be understood that in other modifications of the invention the first retainer 14 may include one or more flange segments which extend less than 360° of the circumference of the elongate body 12. As shown particularly in FIGS. 1 and 2, the first retainer 14 further includes a retaining plug 18 extending outwardly from the elongate body adjacent the upper surface of the support flange 16. The retaining plug 18 engages the aperture 7 in the lowermost wheel to provide additional stability in retaining the wheels 6 on the elongate body portion 12 of the retaining device. The first retainer 14 preferably includes both a support flange 16 and retaining plug 18 as shown in FIGS. 1 and 2, although in other modifications of the invention either the support flange or retaining plug may be eliminated.

Wheel retaining device 10 preferably includes a second retainer 20 proximate the upper end of the elongate body portion 12 for holding the wheels 6 on the elongate body. In the illustrated embodiment, second retainer 20 is shaped so that the wheels may be slipped across the second retainer 20 to position the wheels on or remove the wheels from the elongate body 12 so that the elongate body portion 12, first retainer 14 and second retainer 20 may be monolithically formed as a single unit. Preferably, minimal force is required to slip the wheels across the second retainer 20 and onto the elongate body 12. The second retainer 20 substantially resists forces applied during handling of the filled retaining device to hold the wheels 6 on the elongate body portion 12. The wheels 6 may be removed by pulling the wheels over the second retainer 20, applying sufficient force to overcome the resistance of the retainer 20.

In the illustrated embodiment, the second retainer 20 includes a pair of spaced, longitudinally extending arms 24 and 26. The arms 24 and 26 each have an outward extending shoulder 28 facing the elongate body portion and an inclined surface 30 extending upwardly and inwardly from the outer edge of the shoulder 28 to a transversely extending stretch 32 joining the distal ends of the longitudinally extending arms 24 and 26 together. Coupling the distal ends of arms 24 and 26 together offers several advantages, including strengthening the second retainer 20 and providing a loop which may be used to display the wheel retaining device 10. However, in other modifications of the invention the distal ends of the arms may be separate.

The arms 24 and 26 are resiliently deformable in an inward direction to permit passage of the wheels 6 past the second retainer 20. As the wheels are moved in the direction of arrow A (FIG. 1), the minimal force applied to the inclined surfaces 30 by the wheels deforms the arms 24 and 26 inwardly to permit passage of the wheels past the second retainer 20. Movement of the wheels 6 in the direction of arrow B is initially resisted by the outward extending shoulders 28. The shoulders 28 resist movement of the wheels in the direction of arrow B, retaining the wheels on the elongate body 12 during storage, shipment and handling of the wheel retaining device 10. The wheels may be removed from the elongate body 12 by pulling the wheels with sufficient force to overcome the resistance of shoulders 28 and deform the arms inwardly to permit passage of the wheels past the second retainer 20. Alternatively, the consumer may deform the arms inwardly while moving the wheels in the direction of arrow B.

One advantage of the second retainer 20 of the illustrated embodiment is that it permits passage of the wheels past the second retainer when the wheels are moved onto or removed from the elongate body 12. The second retainer 20 also holds the wheels 6 together, preventing slippage of the wheels along the elongate body. Moving the wheels across the second retainer to fill the elongate body with wheels and remove wheels from the elongate body minimizes the operational steps employed during the packaging of the wheels on the wheel retaining device 10. However, if desired, the wheel retaining device of the invention may be provided with a retainer which is permanently or removably mounted to the retaining device 10 after the elongate body has been filled with wheels. Instead of securely holding the wheels together as is shown in FIG. 1, the second retainer 20 may be configured so that it merely prevents the wheels from being separated from the elongate body 12 during handling of the retaining device 10.

In the preferred form of the invention, wheel retaining device 10 includes both a first retainer 14 and a second retainer 20. However, it will be understood that in other modifications of the invention the wheel retaining device may include only one retainer.

As shown in FIG. 1, the elongate body 12 preferably has a slot 34 extending inwardly into the elongate body 12 from the second retainer 20. The slot 34 facilitates the inward deformation of the arms 24 and 26 for movement of the wheels 6 past the second retainer 18. The length of the slot 34 is subject to variation depending upon such factors as the material employed, the length of arms 24 and 26, the slope of the inclined surfaces 30 and the shoulders 28, and the like. Moreover, the slots 34 may be omitted if desired.

The wheel retaining device 10 of the illustrated embodiment includes tabs or projections 36 extending outwardly from the elongate body portion 12 to engage the interior hubs 8 of the wheels. The tabs 36 provide additional stability, preventing slippage of the wheels along the elongate body and holding each wheel in place. When fewer than the maximum number of wheels are positioned on the elongate body, the tabs 36 prevent the wheels from sliding along the elongate body portion to more securely retain the wheels on the wheel retaining device 10. A user may easily disengage the wheel from the tabs 36 by manually pulling the wheel along the elongate body portion. In other embodiments of the invention, tabs 36 may be omitted if desired.

The wheel retaining device 10 of the present invention preferably includes means for conveniently displaying the wheel retaining device. One such display means is provided by the loop 38 formed by the arms 24 and 26 and the transversely extending stretch 32. The loop 38 may be used to suspend the wheel retaining device from a rod 39 (FIG. 3), peg and the like to display the wheel retaining device. The loop 38 is subject to considerably variation. Instead of a loop, the retaining arms 24 and 26 may be formed in the shape of a hook which may be used to display the retaining device 10. Alternatively, loop 38 may be provided by an element separate from the second retainer 20.

In the illustrated embodiment, wheel retaining device also includes a display base 40 configured for mounted the retaining device 10 to various types of display structures. The underside of the display base 40 includes a connector or retaining hook 42. As is shown in FIGS. 4 and 5, retaining hook 42 is shaped to engage the loop 38 of a second retaining device to link two or more wheel retaining devices together, with the of the uppermost device 10 supporting the wheel retaining devices on a display rod 39. Coupling two wheel retaining devices together allows the consumer to conveniently purchase replacement wheels for both skates when only four wheels are retained on each device 10. The consumer may easily separate the linked devices when he desires to purchase a single wheel retaining device. Moreover, the wheel retaining devices may be displayed by linking more than two wheel retaining devices if desired. Instead of coupling two wheel retaining devices together, retaining hook 42 may be used to releasably secure the device 10 to a display apparatus, vertical display rack or other types of displays as is known in the art.

Display base 40 further includes a pair of outward extending legs 44. Legs 44 may be used to support wheel retaining device 10 in an upright position on a surface such as a counter, display shelf or the like for displaying the device. The consumer may stand the wheel retaining device on legs 44 to store the device after purchase until the replacement wheels are needed. Instead of two legs as shown in the present embodiment, wheel retaining device may have a greater number of legs or one leg extending circumferentially around the base 40. The display base 40 of the present embodiment is configured so that base 40 may be used to secure the wheel retaining device to a display apparatus, vertical display rack such as a grid wall (FIG. 6) or slat wall (FIG. 7) type of display or other types of displays as is known in the art. As is shown in FIG. 6, the wheel retaining device 10 may be mounted to a grid wall display 46 by positioning the device with the retaining hook 42 engaging rod 47 and the legs 44 engaging the wall. The wheel retaining device 10 is mounted to a slot wall display 48 by inserting one of the legs 44 of the display base into a slot 49 and allowing flange 50 and the other leg 44 of the display base 40 to rest against the wall beneath the slot. Although FIG. 7 shows a slot wall display having T-shaped slots, it will be understood that other shapes such as L-shaped slots may also be used.

Providing wheel retaining device 10 with a loop 38, retaining hook 42 and support legs 44 provides the merchant with several options of displaying the wheel retaining device. However, if desired, wheel retaining device may be formed with one or an alternate combination of the display means shown in FIGS. 1 and 2.

In the embodiment of the invention shown in FIG. 8, wheel retaining device **10*a* includes a loop 38*a* spaced from the second retainer 20*a*, a retaining hook 42*a*, and legs 44*a*. Retaining device 10*a* further includes a pair of axles 54 positioned on opposite ends of the elongate body portion 12*a*. The wheel retaining device 10*a* is particularly suitable for use with a display apparatus (not shown) of the type which holds a plurality of objects and individually dispenses the objects through an opening at the lower end of the display, with the products held in the device moving closer to the lower opening each time a product is removed. Axles 54 are shaped to ride along the side rails of the display apparatus with the retaining devices having a generally horizontal orientation instead of the vertical orientation shown in FIG. 8, the axles 54** supporting the wheel retaining devices as the devices move downwardly through the display when a device is removed from the lower end of the display rack.

Another modification of the invention is shown in FIGS. 9–12. As is shown particularly in FIGS. 9 and 10, elongate body **12*b* of wheel retaining device 10*b* includes spaced side rails 58 and 60 and transverse connecting members 62 extending between the rails 58 and 60. Although not shown in the Figures, the portion of the connecting members projecting from the width of the side rails (FIG. 10) is curved to follow the inner profile of the aperture 7*b*. Similarly, the outer surfaces of the rails 58 and 60 may also be provided with a slight curvature to conform to the interior contour of the wheel apertures although this is not shown in the Figures. The side rails 58 and 60 and the transverse members 62 are preferably sized to engage the wheels 6*b* to reduce lateral movement of the wheels 6*b*, although in other modifications of the invention the elongate body 12*b* may be spaced from the inner walls of the wheels if desired. An internal reinforcement rib 64 extends upwardly from the retaining plug 18*b* and is joined to the two connecting members 62. The rib 64 strengthens the elongate body 12*b* in the longitudinal direction for increased stability during application of the wheels 6*b* to the retaining device. In the illustrated modification, the rib 64 extends to the outermost edge of the connecting members 62 to provide increased frictional engagement between the elongate body 12*b* and the wheels 6*b*. However, it is to be understood that the internal rib 64** may have other configurations in accordance with this invention.

A pair of opposed, transverse flanges 66 are joined to the side rails 58 and 60 directly below the second retainer **20*b*. The flanges 66 are separated by a gap 68, and are configured in the shape of one of the connecting members 62 having a section removed. The outer edges 67 of the flanges have a curved contour (not shown) and are shaped to engage the interior wall of the wheel 6*b*. As with the connecting members 62, the flanges 66 may have other shapes if desired. The gap 68 has a function similar to the slot 34 of the embodiment shown in FIG. 1 in that the flanges 66 may move inwardly into the gap 68 when the arms 24*b* and 26*b* are deformed inwardly to slip wheels onto the retainer 10*b***.

Figure 12:
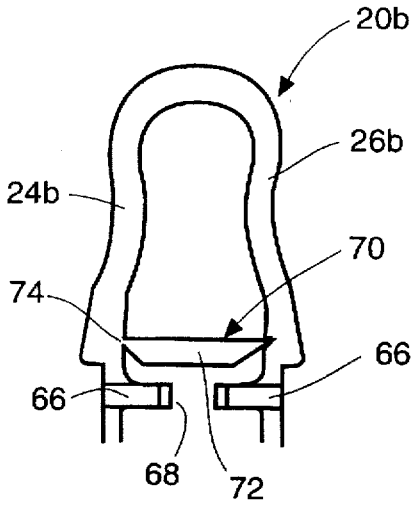

In the embodiment shown in FIGS. 9–12, the second retainer **20*b* includes an integral locking mechanism 70 for securing the wheels 6*b* on the retainer 10*b*. The locking mechanism 70 is initially in a disengaged position, shown in FIGS. 9–11, which allows the arms 24*b* and 26*b* to be resiliently deformed inwardly so that the wheels 6*b* may be moved onto the elongate body 12*b*. When in this disengaged position, the wheels 6*b* may also be removed from elongate body 12*b* as in the previously described embodiments. Such removal may be necessary to replace a damaged or defective wheel, for example. After the wheels 6*b* have been positioned on the body 12*b* and preferably before the package is shipped, the locking mechanism is engaged, as shown in FIG. 12, to prevent the wheels 6*b* from being removed from the elongate body 12*b* by substantially preventing the inward deformation of the lower portion of the arms 24*b* and 26*b***.

In this embodiment, the locking mechanism 70 includes a flange 72 which is connected to the interior of the arm **24*b* by a thin section of material which form a hinge 74. The distal end of the flange 72 is shaped to slip into a groove 76 formed on the interior of the opposite arm 26*b*. When the locking member is engaged, the distal end of the flange 72 engages the shoulder 78 of the groove which prevents removal of the distal end from the groove, securely locking the wheels on the elongate body 12*b*. The engaged locking mechanism is positioned below the horizontal plane of the top surface of the wheel 6*b*, requiring that an instrument of tool be used to release the locking mechanism. When a consumer desires to remove the wheels from the retainer 10*b*, he uses the tool to pull upwardly on the flange 72 causing the flange 72 to become disengaged from the groove 76 or the hinge 74 to fracture, thereby releasing the locking mechanism 70. Once the flange is released from at least one of the arms 24*b* and 26*b*, the arms may be deformed inwardly as previously described to permit the wheels to be pulled off the elongate body 20*b* and over the second retainer 12*b***.

The locking mechanism 70 of this embodiment is of particular advantage in that it provides a means of ensuring the wheels 6b will remain intact on the retaining device 10b until the consumer actively releases the locking mechanism to removes the wheels. Since the flange 72 is detached from the arm 24b when the locking mechanism 70 is released, the mechanism 70 also provides evidence that the wheels have not been previously removed before the package is purchased by the consumer.

Figure 13:
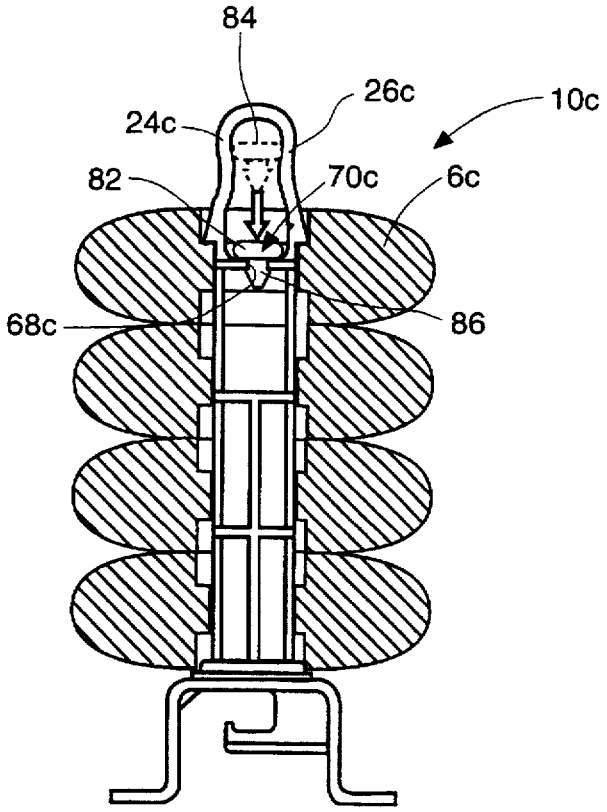
FIG. 13 is a side view of another embodiment of a wheel retaining device.

Turning to FIG. 13, another modification of the invention is shown. With wheel retaining device 10c, the locking mechanism 70c is not integrally molded with the elongate body 12c. Instead, locking mechanism 70c includes a removable plug 82 which fits into the gap 68c between the spaced flanges 66c. The plug 82 substantially prevents inwardly deformation of the arms 24c and 26c when in place, securely locking the wheels 6c on the retaining device 10c. In this embodiment, the plug 82 includes an enlarged top portion 84 to facilitate insertion and removal of the plug 82 and a barb-shaped tip 86 which holds the plug 82 in place until it is removed. The removable plug 82 provides means for securing the wheels 6c in place during shipment and handling. Another advantage of the removable plug 82 is that it may be reused in the event the consumer wants to reuse the retaining device 10c to store wheels 6c when not in use, such as when the skater alternates between different wheel types for skating under different conditions.

Except as set forth above, the modification of FIGS. 8, 9–12, and 13 resembles those of the preceding modification and the same reference numerals followed by the subscripts a–c are used to designate corresponding parts.

As is apparent from the foregoing, this invention provides a wheel retaining device for conveniently and efficiently holding a plurality of wheels. The wheels may be easily slipped past the second retainer and positioned on the elongate body of the retaining device. The first and second retainers securely retain the wheels on the device during storage, handling and shipment of the wheel retaining device. The display structure employed in the various modifications of the invention provide a means for conveniently and efficiently displaying and attractively marketing a plurality of wheel retaining devices for purchase by a consumer.

The foregoing descriptions of specific embodiments of this invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. In combination, a wheel retaining device and at least one wheel having an aperture formed therethrough, said wheel retaining device comprising:

an elongate body extending through said aperture of said wheel, first and second retainers carried by said elongate body for holding said wheel thereon, at least one of said retainers being resiliently deformable to permit movement of said wheel past said at least one of said retainers and onto said elongate body, a locking mechanism adjustable between a disengaged position, for movement of said wheel onto said elongate body, and an engaged position, for resisting the resilient deformation of said at least one of said retainers to securely retain said wheel on said elongate body.

2. The combination of claim 1 in which said locking mechanism is integrally formed with said elongate body and said at least one of said retainers.

3. The combination of claim 1 in which said first retainer includes a pair of spaced arms and said locking mechanism includes a flange hingedly mounted to one of said arms, said flange engaging the other of said arms when said locking mechanism is in said engaged position.

4. The combination of claim 1 in which said locking mechanism is provided by a locking pin which is positioned to prevent inward deformation of said at least one of said retainers.

5. The combination of claim 4 in which said at least one of said retainers includes a pair of spaced arms and said locking pin is positioned between said arms to substantially prevent inward deformation of said arms when said locking mechanism is in said engaged position.

6. A wheel retaining device for retaining a plurality of wheels each having an aperture formed therein, said wheel retaining device comprising:

an elongate body insertable through said aperture of said wheels, first and second retainers carried by said elongate body for holding said wheels on said elongate body, at least one of said retainers being resiliently deformable to permit movement of said wheel past said at least one of said retainers for position said wheels on said elongate body and removing said wheels from said elongate body, and a locking mechanism cooperable with said at least one of said retainers to secure said wheels on said elongate body, said locking mechanism being adjustable between an engaged position for resisting the resilient deformation of said at least one of said retainers to secure said wheels on said elongate body and a disengaged position for movement of said wheels onto and off of said elongate body.

7. The wheel retaining device of claim 6 in which said locking mechanism is integrally formed with said elongate body and said at least one of said retainers.

8. The wheel retaining device of claim 6 in which said first retainer includes a pair of spaced arms and said locking mechanism includes a flange hingedly mounted to one of said arms, said flange engaging the other of said arms when said locking mechanism is in said engaged position.

9. The wheel retaining device of claim 6 in which said locking mechanism is provided by a locking pin which is positioned to prevent inward deformation of said at least one of said retainers.

10. The wheel retaining device of claim 9 in which said at least one of said retainers includes a pair of spaced arms and said locking pin is positioned between said arms to substantially prevent inward deformation of said arms when said locking mechanism is in said engaged position.

11. In combination, the wheel retaining device of claim 6 and a plurality of wheels each having an aperture formed therein, said elongate body extending through said apertures and said first and second retainers retaining said wheels on said elongate body.

* * * * *